United States Patent [19]

Sarll

[11] 3,973,623

[45] Aug. 10, 1976

[54] HEAT EXCHANGE APPARATUS

[75] Inventor: Peter Geoffrey Sarll, Upminster, England

[73] Assignee: Mobil Oil Corporation, New York, N.Y.

[22] Filed: Dec. 6, 1974

[21] Appl. No.: 530,243

[30] Foreign Application Priority Data

July 2, 1974 United Kingdom ..... 29283/74

[52] U.S. Cl. ..... 165/94; 15/246.5

[51] Int. Cl.[2] ..... F28G 15/08; F28G 3/12

[58] Field of Search ..... 165/94; 15/104.1 X; 259/16 F

[56] References Cited

UNITED STATES PATENTS

| | | | |
|---|---|---|---|
| 2,943,845 | 7/1960 | Vaklitsch | 165/94 X |
| 3,395,419 | 8/1968 | Munlist et al. | 165/94 X |
| 3,731,339 | 5/1973 | Addison | 165/94 |

FOREIGN PATENTS OR APPLICATIONS

| | | | |
|---|---|---|---|
| 586,169 | 11/1959 | Canada | 165/94 |

*Primary Examiner*—Charles J. Myhre
*Assistant Examiner*—Theophil W. Streule, Jr.
*Attorney, Agent, or Firm*—Charles A. Huggett; Raymond W. Barclay

[57] ABSTRACT

The invention provides apparatus for heat exchange treatment of a liquid having a mean density within a predetermined range, comprising:

at least one substantially horizontal cylindrical elongated tube with an inlet at one end thereof and an outlet at the other end thereof for flow of said liquid therethrough;

means for sweeping the outer surface of said cylindrical tube with fluid for conveying heat; a hollow gas tight shaft rotatably supported within said cylindrical tube so as to be substantially coaxial with said tube;

a plurality of preferably spring-loaded longitudinal scraper blades mounted in sequence upon and along the length of said shaft and adapted to scrape substantially all the inner surface of said cylindrical tube upon rotation of the shaft; drive means for rotating the shaft during the passage of liquid therethrough;

and wherein the weight per unit length of tube, of said liquid displaced at maximum mean operational temperature thereof by said shaft and scrapers amounts to at least ninety percent of the weight per unit length of tube of said shaft and scrapers.

3 Claims, 2 Drawing Figures

HEAT EXCHANGE APPARATUS

BACKGROUND OF THE INVENTION

1. Field of the Invention

The present invention relates to apparatus for treatment of a liquid in one or a series of substantially horizontal cylindrical elongated tubes. More particularly the invention concerns apparatus in which a cylindrical tube filled with liquid undergoing a process such as heat exchange, mixing, crystallization and precipitation, involving the settling out of solid material from the liquid, is provided with means for agitating the liquid and cleaning the deposits from the interior surface of the tube.

2. Description of the Prior Art

Apparatus, generally referred to as scraped surface heat exchangers, have heretofore been applied for instance in the treatment of petroleum oil for the purpose of dewaxing the oil, in the crystallization of organic chemicals and in heating or cooling viscous materials.

The desired heat transfer in such apparatus is generally brought about by surrounding the abovementioned cylindrical shell with means for sweeping the outer surface of the cylindrical tube with fluid for conveying heat. Such means is commonly provided in the form of an outer concentric cylindrical tube connected to a supply of flowing heat transfer fluid, e.g. chilled brine, and apparatus in this form is referred to as a double pipe heat exchange unit.

The transfer of heat to or from substances having a high viscosity or which crystallize under certain conditions cannot be procured economically in an ordinary heat exchanger. These substances form crystals or adhesive films on the heat transfer surface which considerably impair the rate of heat transfer between the substance and the heating or cooling medium. By means of spring loaded scraper blades constantly removing the films or crystals the rate of heat exchange could be maintained at an economic level.

The means for cleaning deposits from cylindrical shell surface accordingly normally comprises one or more pairs of scraper blades in the form of metal strips mounted to abut, in spring loaded manner against the surface to be scraped, on a rotary drive shaft coaxial with the surface of the cylindrical shell. This central shaft is in turn mounted in bearings at least at one end of the tube, usually at each end, and generally also at intermediate points along its length, and extends outside the tube through a sealing gland to be coupled to drive means for rotation of the shaft, whereby deposits are continually removed which would otherwise accumulate and not only hinder liquid flow but also reduce heat transfer efficiency.

Typical dimensions of such apparatus include a unit pipe length of 40 feet and an internal diameter of 12 inches. It will be apparent that the rotating assembly of scraper blades and shaft must be supported at regular intervals along the shaft to prevent the assembly resting on the lower part of the pipe. For this purpose plain bearings are fitted and the whole bearing lubrication requirements must be met by the liquid being processed. In the case of certain such liquids the lubrication properties are far from ideal. Bearings of a design suitable for all liquids would be difficult to justify on economic grounds because of the generally rough standard of scraped surface heat exchanger manufacturing tolerances.

A typical heat exchange unit of the kind described above conventionally forms part of a double pipe heat exchanger composed of a plurality of such units connected in tiers for the series flow of liquid to be treated therethrough. Even when serially connected in this way, however, each unit usually has to be of great length, and it is often a problem to maintain constant the force with which the blades contact the tube surface. This problem is caused by the relatively reduced support for the weight of the shaft and scrapers in sections remote from the bearings, and leads to incomplete cleaning of the pipe surface above the level of the shaft, with consequent reduction in heat exchange efficiency and obstruction of flow.

These weight and bearing problems increase as the diameter of the equipment is increased.

In U.S. Pat. No. 3,587,729 a double walled tubular heat exchanger of the general type described above is disclosed in which pneumatic or hydraulic adjusting devices are arranged between the blades and the supporting shaft, for pressing the scraper blades against or for lifting them away from the inner wall of the heat exchanger. This apparatus is not, however, addressed to the problem of bearing wear and variations in scraper pressure due to the weight of the shaft between supports, and its use would aggravate rather than alleviate these problems.

In U.S. Pat. No. 3,607,400 a scraped surface double pipe chiller is described with blades carried on and rotated by a central shaft journalled at one end, the cleaning action being realized by longitudinal reciprocation of the rotating shaft, so that the blades, which occupy only a small proportion of the length of the shaft at the end thereof and scrape only a short length of the vessel wall at one time, may reach different parts of the vessel surface. Reference is made to the problem of contacting the entire inner surface of the vessel with equal force, caused by the actuating shaft and scraping equipment at the end of it being heavy and having a density different from that of the liquid within the scraping action is being performed. The problem is approached in this U.S. patent by providing an actuating shaft having an adjustable weight per unit length and which can be constructed so that the weight of the shaft is substantially equal to the weight of the liquid displaced by the shaft.

In U.S. Pat. No. 3,731,339 an attempt is described to extend the application of a buoyant shaft to a scraped surface double pipe heat exchanger having a hollow sealed central shaft supported in bearings at each end at intermediate points and carrying scraper blades along substantially all its length on a superstructure of hollow members sealed against entry of liquid. In spite of the predominance of hollow members the structure only achieves a reduction of 25 percent in the effective weight of the scraper assembly.

The problem of equalizing scraper action in blades mounted along the whole length of a conventional double pipe heat exchanger unit has thus not hitherto been solved.

SUMMARY OF THE INVENTION

It is an object of the present invention to mount scraper blades in a double pipe heat exchanger directly upon and along the length of a central rotary drive shaft for equalized and uniform cleaning action upon substantially all the exchanger surface, with adequate agitation and throughput of the treated liquid.

It is a further object of this invention to support a central rotary drive shaft through a double pipe scraped surface heat exchanger in such a manner that bearing load is minimized and scraper blades mounted on opposite sides of and along the length of the shaft bear against all the exchanger surface with substantially equal (i.e., within 10 percent) whereby a uniform cylindrical scraping action is achieved.

According to the present invention I provide apparatus for heat exchange treatment of a liquid having a mean density within a predetermined range, comprising:

at least one substantially horizontal cylindrical elongated tube with an inlet at one end thereof and an outlet at the other end thereof for flow of said liquid therethrough;

means for sweeping the outer surface of said cylindrical tube with fluid for conveying heat;

a hollow gas tight shaft rotatably supported within said cylindrical tube, preferably in plain bearings at least at one end and usually at both ends of the tube, so as to be substantially coaxial with said tube;

a plurality of preferably spring-loaded longitudinal scraper blades mounted in sequence upon and along the length of said shaft and adapted to scrape substantially all the inner surface of said cylindrical tube upon rotation of the shaft;

drive means for rotating the shaft during the passage of liquid therethrough;

and wherein the weight per unit length of tube, of said liquid displaced at maximum means operational temperature thereof by said shaft and scrapers amounts to at least ninety percent of the weight per unit length of tube of said shaft and scrapers.

DESCRIPTION OF SPECIFIC EMBODIMENTS

Figure 1:
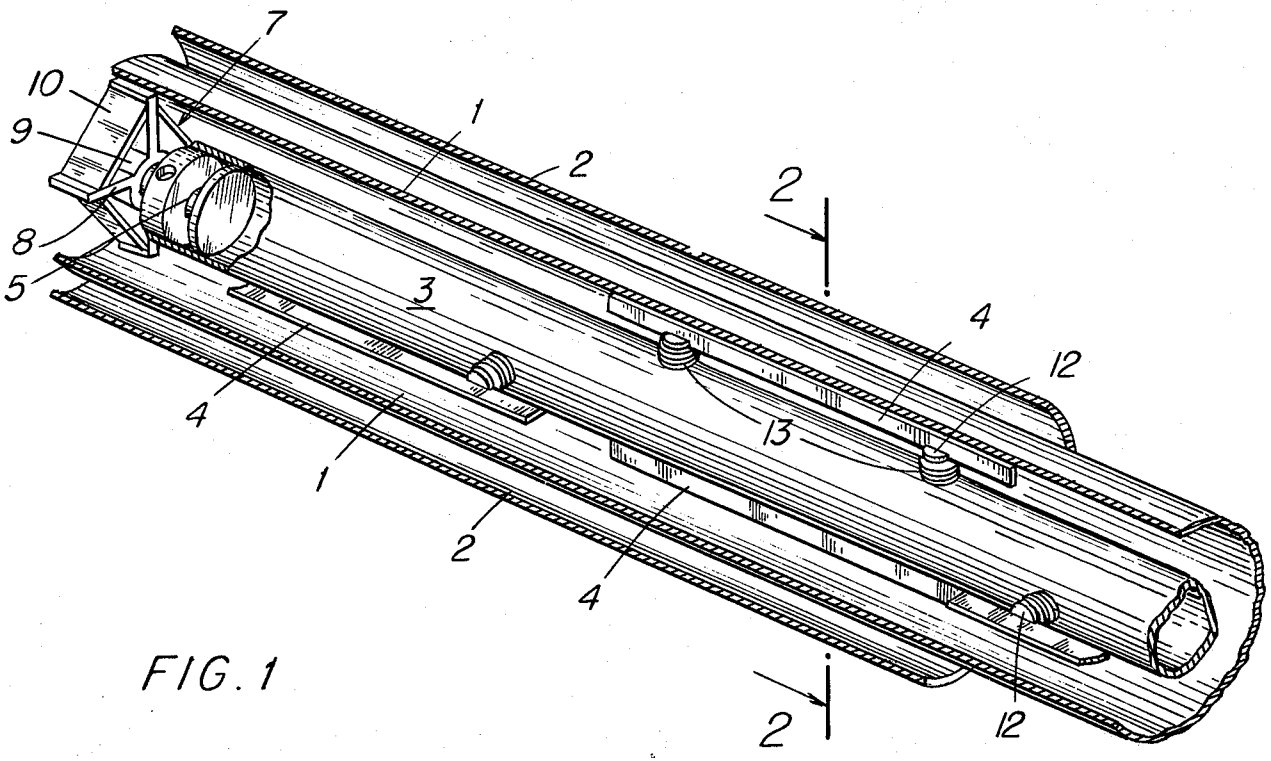
FIG. 1 is a partly cut away perspective view of a section of a double pipe heat exchanger according to the invention.
Figure 2:
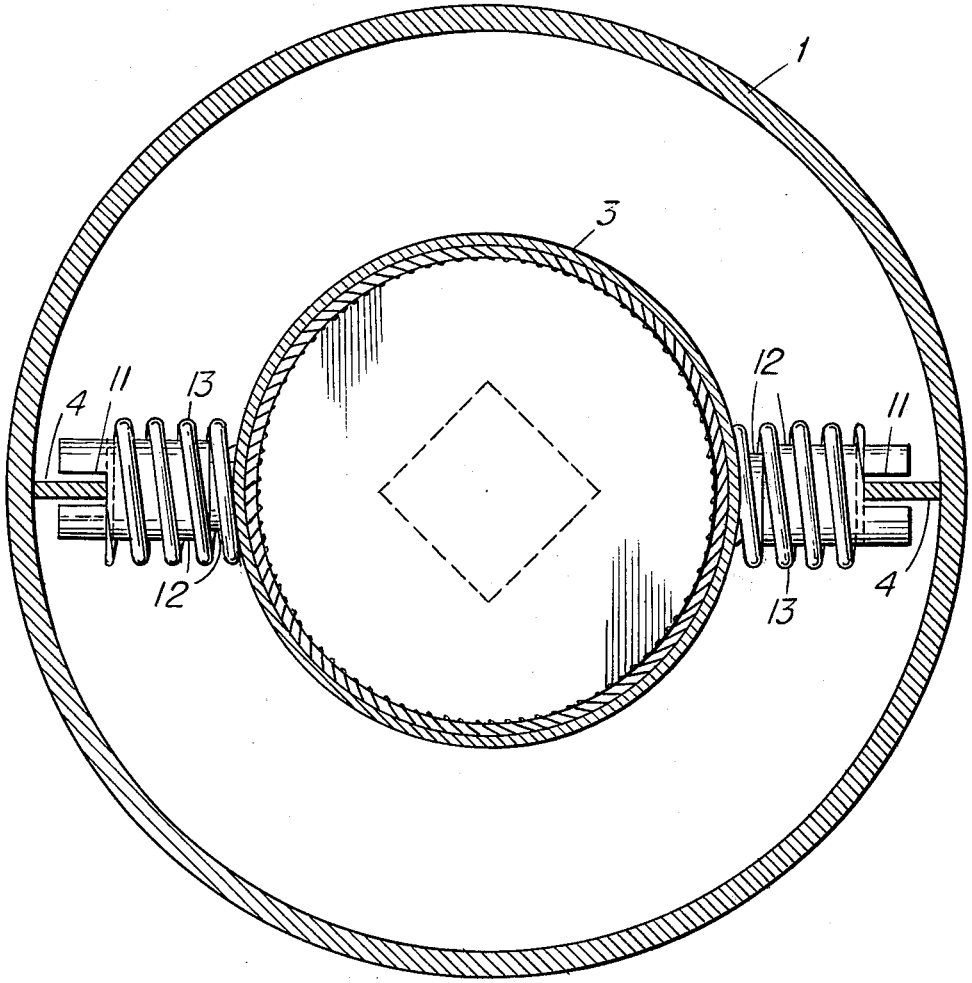
FIG. 2 is a cross-section on the line 2—2 of FIG. 1.

The present invention is applicable to any treatment of a liquid in a tube in which transfer of heat to or from the liquid is accompanied by a tendency for solid matter to settle out, which must be carried out of the tube. In order to set the invention up it is necessary to know the density of the liquid under treatment, which in practice will be a mean value taking into account variations due to changes such as precipitation taking place as a result of the heat transfer. Moreover, the density of interest is that of the liquid at operational temperature, but a knowledge of the density-temperature characteristic of the liquid will enable one to fulfill the conditions of the invention on the basis of density quoted at standard temperature and pressure. For a given liquid such as a petroleum oil there will be a predetermined range of mean density for which the apparatus may be considered effective. Liquids for which apparatus of this type is especially useful frequently exhibit densities of 0.7 to 0.9 grams per $cm^3$ or higher, at ordinary temperatures, and this range may be taken as typical of operational density in many preferred uses.

It will be appreciated that the apparatus of the invention is preferably a conventional double pipe scraped surface heat exchanger to the extent that it possesses the following features:

a. at least one substantially horizontal cylindrical tube with an inlet at one end of the tube and an outlet at the other end of the tube to permit liquid under treatment to flow through the tube; the tube being usually but one of a series of such tubes mounted in tiers and connected at their respective ends to each other by U-bends to permit the liquid to flow through the several tubes in sequence;

b. means for sweeping the outer surface of the cylindrical tube, or of each such tube, with fluid for conveying heat, normally provided by mounting each tube within a respective concentric tube of larger diameter to constitute a jacket for passage of heat transfer of fluid;

c. a rotatable shaft journalled centrally within the cylindrical tube in plain bearings, two of which for each tube being the end bearings through one of which the shaft extends for the purpose of being driven, other plain bearings being at intermediate intervals along the shaft to support it;

d. a plurality of spring-loaded scraper blades extending in a generally longitudinal direction and mounted in sequence upon and along the length of the shaft and adapted, i.e., shaped, positioned and supported, to scrape between them substantially all the inner surface of the cylindrical tube upon rotation of the shaft;

e. drive means such as a motor coupled to each shaft present, for rotating the shaft during the passage of liquid through the tube.

There is accordingly no need to enlarge upon these features in detail except in so far as they may be subject to modification as indicated in the succeeding description.

In order to fulfill the conditions imposed by the present invention it is in general necessary that the shaft shall be hollow and gas tight, or at least composed substantially entirely of hollow gas tight sections, in order to achieve the requisite buoyancy; it is not beyond the scope of the invention however, to include sections which are not hollow or not gas tight so long as the requisite buoyancy exists.

Preferably the shaft comprises a plurality of tubular gas tight sections joined end to end and each entending between spider bearing supports located at intervals along the tube. It will be appreciated that the short section of shaft within the bearing may usefully be solid, for instance a stub shaft linking the hollow sections together in gas tight manner, preferably by welding.

It is an advantage of the present invention that the number of such intermediate bearing spiders may be kept to a minimum and relatively lightly constructed since their wear is minimal. A particularly suitable form of spider support illustrated in the accompanying drawings, allows for easy adjustment of fit within the tube. The entire assembly of shaft, scrapers and spider supports is designed to be withdrawn endwise out of the tube for servicing and the spiders are therefore made to give a free frictional fit inside the tube.

The feature of primary importance in the present invention is that the weight per unit length of tube, of the liquid displaced at maximum means operational temperature of the liquid by the shaft and scrapers shall reach at least nine tenths of the weight of the shaft and scrapers themselves. That is to say, the assembly of shaft and scrapers shall be nearly or completely floating in the liquid. It is in fact preferable that some residual weight be left for the spiders to support, lest the spiders tend to rotate with the shaft in the absence of restraint, and damage the tube surface or even wear through it.

The weight per unit length, of the shaft, is of course determined from knowledge of the dimensions and material of the shaft, and the same is true of the scrapers although the latter, with their fastenings, can readily also be weighed directly. Likewise the volume, and hence the weight, of the liquid displaced by the shaft and mounted scrapers, can be calculated from their dimensions. The metals from which these members are typically constructed have densities ranging from 7 to 9 grams per $cm^3$, i.e., of the order of ten times that of typical liquid to be treated.

In order to raise to the required value the volume liquid to be displaced it becomes a matter in practice of using a hollow shaft of large enough diameter, given a particular thickness of shaft wall. For material in common use of one quarter inch wall thickness, and for liquids commonly treated in such apparatus as mentioned above, it is found that a shaft of six inches diameter meets the conditions of the invention.

A suitable spider support for use in the apparatus of the invention consists essentially of metal strips welded to a central tube to form an equilateral rectangular cross as seen edgewise to the strips, interrupted by the central tube, with one strut joining each strip to the next at about 45° to the strips and leaving the extreme ends of the strip exposed. In this way the said ends (normally only one of them) can readily be shortened to improve the desired free frictional fit in a tube which is not an exact true cylinder. The central tube provides a bearing for the supported shaft.

Apparatus embodying the invention offers numerous advantages. It is simple in construction, having no need for extra supports alongside the shaft, for the blades, nor for any extra buoyant members besides the shaft itself or any complex counterweighting system. The scope for dead space in the circulation of liquid is reduced by virtue of the high proportion of the liquid filled annulus traversed by blades compared with prior apparatus, and the blades can be mounted in any desired locations on the shaft. Construction in unit lengths is facilitated particularly by the spider connections. Above all the apparatus provides balanced contact of blade on tube surface, whereby a good surface condition is maintained with consequent thermal efficiency and heat economy. Bearing wear and the number of bearings required per unit length of shaft are both reduced even if the treated liquid is a poor lubricant.

Referring more particularly to the drawings, a cylindrical metal tube 1 for containing liquid to be treated is surrounded by a second concentric metal tube 2 which provides a jacket for heat transfer fluid. A third cylindrical metal tube 3 constitutes the hollow drive shaft for scraper blades 4 mounted in diametrically opposed pairs and displaced through 90° around the shaft in relation to the longitudinally next pair, as shown. The hollow shaft 3 is sealed and supported on stub shaft 5 to which it is welded, and which is journalled in bearing 6 forming part of spider support 7 which is constructed as already described, with cross pieces 8 welded to the central tube 9 and to struts 10, the whole spider being a free frictional fit in tube 1.

A number of spider supports of the type illustrated, are provided at intervals of for instance 8 feet along the shaft where sections of the shaft are thus joined endwise to one another by way of stub shafts such as 5, to make up total lengths of, say, 40 feet, mounted in end bearings (not shown) at the ends of the tube.

Each blade 4 is supported, in slots 11 formed in two telescopic posts 12 welded to shaft 3 so that the coil springs 13 encircling the posts urge the blade away from the shaft and towards the internal surface of tube 1. The tube 1 may for instance be 12 inches in diameter and the shaft 3 6 inches or more in diameter, being made of quarter-inch metal; the buoyancy of the shaft 3 is sufficient to support at least 90 percent of the weight of shaft 3 and blades 4 so that pressure on opposed blades in each pair is substantially equalized and bearing pressure is substantially inhibited.

What I claim is:

1. Apparatus for heat exchange treatment of a liquid having a mean density within a predetermined range, comprising:

at least one substantially horizontal cylindrical elongated tube with an inlet at one end thereof and an outlet at the other end thereof for flow of said liquid therethrough;

means for sweeping the outer surface of said cylindrical tube with fluid for conveying heat;

a hollow gas tight shaft having a plurality of tubular gas tight sections joined end to end rotatably supported within said cylindrical tube so as to be substantially coaxial with said tube, each said section extending between bearing supports located at intervals along the tube with a free frictional fit therein to permit the entire assembly of shaft, scrapers and supports to be withdrawn endwise for servicing;

a plurality of longitudinal scraper blades mounted in sequence upon and along the length of said shaft and adapted to scrape substantially all the inner surface of said cylindrical tube upon rotation of the shaft; drive means for rotating the shaft during the passage of liquid through said cylindrical tube;

and wherein the weight per unit length of tube, of said liquid displaced at maximum mean operational temperature thereof by said shaft and scrapers amounts to at least ninety percent of the weight per unit length of tube of said shaft and scrapers whereby the load in said bearing supports is minimized and uniform scraping action is achieved as the scraper blades bear against all the exchanger surface with substantially equal force.

2. Apparatus according to claim 1, wherein the scrapers are spring-loaded and disposed in diametrically opposed pairs, each pair being displaced round the shaft in relation to the next pair, and the total length of all the pairs being substantially equal to the total length of tubular shaft, apart from any fixed scraper blades present.

3. Apparatus according to claim 2, wherein each scraper blade is mounted in slots in at least two telescopic posts each welded to the shaft and encircled by a coil spring applying pressure between the blade and the shaft.

* * * * *